US005740718A

United States Patent [19]

Rathweg

[11] Patent Number: 5,740,718

[45] Date of Patent: Apr. 21, 1998

[54] MODULAR PISTON ROD ASSEMBLY WITH INTEGRATED HIGH-WEAR COMPONENTS

[75] Inventor: Christopher Rathweg, Lafayette, Colo.

[73] Assignee: Binks Manufacturing Company, Franklin Park, Ill.

[21] Appl. No.: 734,466

[22] Filed: Oct. 17, 1996

[51] Int. Cl.[6] ..... F16J 15/18

[52] U.S. Cl. ..... 92/168; 92/257; 92/255; 92/128; 277/124

[58] Field of Search ..... 277/124, 123; 92/170.1, 255, 257, 258, 168, 128; 74/44

[56] References Cited

U.S. PATENT DOCUMENTS

| | | | |
|---|---|---|---|
| 1,584,843 | 5/1926 | Carroll | 277/124 |
| 1,595,401 | 8/1926 | Humason | 92/170.1 |
| 1,817,095 | 8/1931 | Pewick et al. | 92/170.1 |
| 2,837,898 | 6/1958 | Ahlstrand | 92/170.1 |
| 3,184,124 | 5/1965 | Beck | 74/44 |
| 4,646,580 | 3/1987 | Dunn | 74/44 |

*Primary Examiner*—Thomas E. Denion
*Attorney, Agent, or Firm*—Wallenstein & Wagner, Ltd.

[57] ABSTRACT

A piston rod assembly is provided for operation in an outer cylinder. The piston rod assembly includes a first rod having first and second regions, wherein the first region has a hole transversely aligned relative to the longitudinal axis of the first rod. A hollow, cylindrical bushing is disposed within the hole of the first rod. A second rod has first and second regions, the first region of the second rod being removably secured to the second region of the first rod. A packing sleeve for fluidly sealing the piston rods and outer cylinder includes a cylindrical shell having first and second portions circumferentially and adjustably disposed about at least the second region of the first rod and the first region of the second rod. First packings include a plurality of stacked annular seals mounted in the first portion of the cylindrical shell of the packing sleeve, such that the inner surfaces of the seals are in slidable and sealable contact with the outer surface of the first rod. Second packings include a plurality of stacked annular seals mounted between the first and second portions of the shell of the packing sleeve, such that the inner surfaces of the seals of the second packings are in slidable and sealable contact with the outer surface of the second rod. A packing nut assembly may be mounted at one end of the outer cylinder. Adjustment of the packing nut assembly displaces the packing sleeve, thereby compressing the first and second packings.

30 Claims, 5 Drawing Sheets

MODULAR PISTON ROD ASSEMBLY WITH INTEGRATED HIGH-WEAR COMPONENTS

TECHNICAL FIELD

The present invention relates generally to the maintenance of high-wear surfaces and components in a fluid pump assembly and, more particularly, to a sealing sleeve for mounting a first and a second sealing material about a double-action pump.

BACKGROUND OF THE INVENTION

Reciprocating pistons serve as the active component in positive displacement pumps, which are used in a wide variety of applications. For example, reciprocating pumps have been used to deliver paint in paint spray systems, and as fluid compressors in refrigeration and other heat transfer systems. Such pumps may employ single-acting or double-acting designs. In its most general sense, a reciprocating pump consists of a motor-driven piston that reciprocates in a cylinder. The piston delivers fluid in a system by drawing the fluid into the cylinder and pumping it out under pressure. The double-acting reciprocating pump generally operates in an analogous manner although, unlike single-acting pumps, usually contains separate intake and discharge chambers within the cylinder to improve efficiency.

Because of the continuous, dynamic motions occurring in reciprocating pumps, such pumps contain a number of surfaces and components prone to a considerable degree of wear. Seals, bushings, grommets and other resilient components often serve critical functions in these pumps. For instance, the double-acting pump typically contains one or more sets of packed annular seals surrounding its piston. These "packings" assist in defining sealed boundaries for the chambers within the pump's cylinder. Stationary packings tend to create a high-wear surface on the outer surface of the piston as the piston cycles across the seals. On the other hand, the cyclic action of packings directly attached to the piston tend to create a high-wear surface on the inner surface of the cylinder. The piston and cylinder, as well as the packings, eventually wear out and must be replaced. In addition, the reciprocating pump will employ some type of bushing or other bearing in conjunction with whatever means are used to couple the piston to the pump's motor. This bushing is subject to various dynamic forces and hence also is prone to a high degree of wear.

A recurring problem in prior art pumps involves the amount of time and labor that must be expended when replacing or performing other maintenance on these components and surfaces. In order to access the bushing, for instance, the coupling means must be disassembled. In order to access the inside of the cylinder, the piston and the packings, the entire fluid section of the pump must be disassembled.

Furthermore, in reciprocating pumps, the compression on the seal packings ordinarily must be adjusted a number of times during the operating life of the packings. In prior art pumps, particularly those which have packings directly attached to the piston, this ostensibly simple adjustment process is rendered difficult and time-consuming by the fact that the fluid section must be disassembled in order to gain access to the packings. For example, in a reciprocating pump, a first compressible sealing material is typically mounted in a stationary manner at one end of a pump cylinder while a second compressible sealing material is typically mounted directly to an end of a reciprocating piston. When fluid leaks are observed at the end of the pump cylinder because of degradation of the first sealing material, a simple adjustment of a nut at the end of the cylinder is utilized to compress the first sealing material and tighten the seal about the piston. Although it is not as readily observable as the first sealing material, the second sealing material will also likely degrade, rendering the pump less efficient. However, in order to compress the second sealing material, the entire pump assembly must be taken apart. This involves considerable downtime, during which the pump cannot be used for its intended purpose.

The present invention is provided to alleviate these and other problems in the prior art.

SUMMARY OF THE INVENTION

In view of the shortcomings of the prior art, it is a general object of the present invention to provide a piston rod assembly, the design of which facilitates maintenance thereof. This is accomplished by providing a modular piston rod assembly wherein all replaceable high-wear materials are integrally associated with such assembly in order to facilitate maintenance and replacement of the piston and associated components. Incorporating all high-wear components and surfaces into a single unit enables all internal seal packings to be adjusted without disassembly. This design also effectively eliminates the inside surface of a cylinder as a high-wear surface. It is well known that inside-diameter (ID) finishing, which is required where the inside surface of the cylinder is a high-wear surface, is much more costly than outside-diameter (OD) finishing performed on the piston rod itself.

The modular piston rod assembly permits all seals associated therewith to be compressed in a single step without requiring disassembly of the fluid section. The modular assembly may also provide a simple visual means for indicating the degree of wear, and hence the remaining life, of the seals of a piston rod assembly.

Additionally, a piston rod assembly is provided wherein the bushing associated with the wrist pin is integrated into the assembly, thereby eliminating the need for a separate crosshead and consequently eliminating an additional and separate high-wear component.

An assembly for fluidly sealing a piston member in a pump includes a piston member having an outer surface. A first compressible sealing material is disposed adjacent the piston member, and the inner surface of the first sealing material sealingly contacts the outer surface of the piston member. A second compressible sealing material is also disposed adjacent the piston member, and the inner surface of the second sealing material sealingly contacts the outer surface of the piston member. If desired, additional sealing materials may likewise be included. A sleeve disposed adjacent the outer surface of the piston member is provided for mounting the first and second sealing materials in a spatial, axial relation to each other. Axial displacement of the sleeve at one end compresses both the first and second sealing materials.

In another embodiment, a piston rod assembly includes a first rod having first and second ends, and a second rod removably attached to the second end of the first rod. A first compressible sealing material is disposed adjacent the first rod, and the inner surface of the first sealing material sealingly contacts at least a portion of the outer surface of the first rod. A second compressible sealing material is disposed adjacent the second rod, and the inner surface of the second sealing material sealingly contacts at least a portion of the outer surface of the second rod. If desired, additional sealing materials may likewise be included. A sleeve disposed adjacent the outer surfaces of the first and second piston rods is provided for mounting the first and second sealing materials in a spatial, axial relation to each other. Axial displacement of the sleeve at one end compresses both the first and second sealing materials.

The piston rod assembly may be housed in an outer cylinder. One end of the piston rod may be operatively coupled to a connecting rod by a pin and the connecting rod coupled to a motor. The pin connection may be housed in a cylinder head mounted to the outer cylinder. The cylinder head may include a back plate on which slots are formed. The slots operate as fulcrum points for a lever used to facilitate removal of the piston rod assembly from the other end of the outer cylinder. A packing nut assembly adjustably engaged with this other end of the outer cylinder may be provided. Adjustment of the packing nut assembly causes axial displacement thereof, which in turn causes axial displacement of the sleeve towards the first end of the outer cylinder, thereby compressing both sealing materials. The packing nut assembly may also be adapted to open the other end of the outer cylinder to remove the piston rod assembly therefrom for maintenance purposes.

In another embodiment, an assembly for translating the rotational motion of a motor crankshaft to linear motion of a piston member, without the use of a discrete crosshead member, is provided. The assembly includes a piston member having a hole proximate one end of the piston member. The assembly also includes a connecting member having a hole proximate one end of the connecting member. A hollow, cylindrical bushing is disposed within the hole of the piston member. A pin is provided, in operative and removable engagement with the bushing of the piston member and the hole of the connecting member, to translate the rotational motion of the crankshaft to linear motion of the piston member.

Other advantages and aspects of the present invention will become apparent upon reading the following description of the drawings and detailed description of the invention.

DETAILED DESCRIPTION

Figure 1:
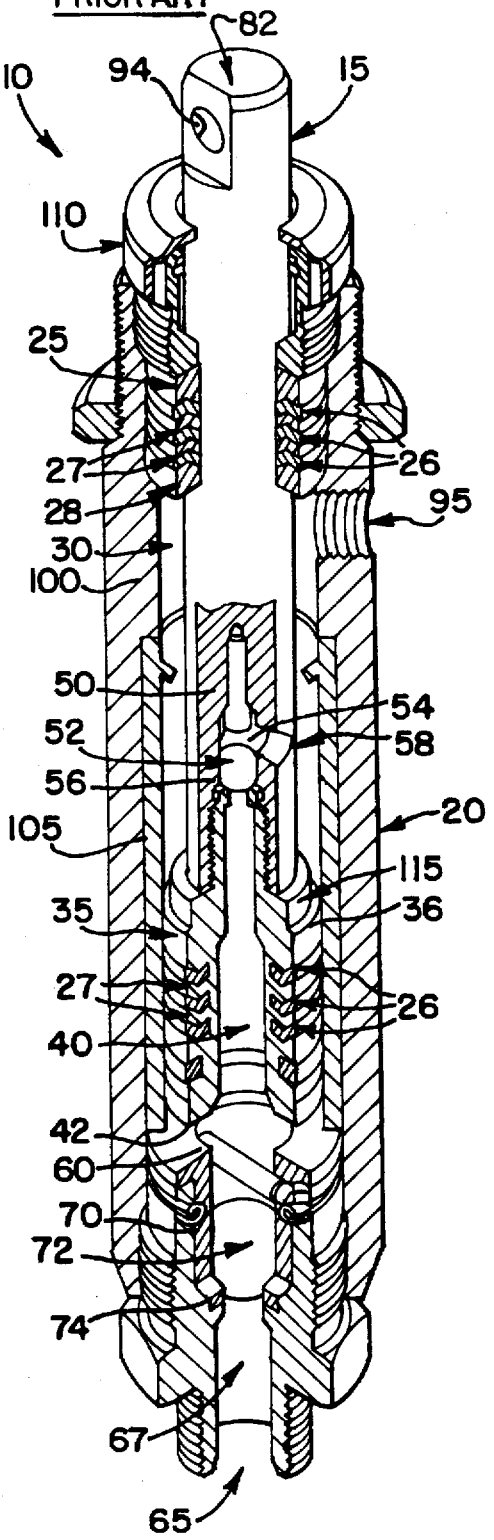
FIG. 1 PRIOR ART
FIG. 1 is a perspective, partial cross-sectional view of a prior art reciprocating pump.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows the fluid section 10 of a typical double-acting piston pump known in the prior art. The piston rod 15 reciprocates within a cylinder 20. A set of seals or packings 25 is located in the upper portion of the cylinder 20. The packings 25 typically consist of a series of annular seals 26,27. The seals 26,27 consist of alternating, heterogeneous sealing materials such as a polymer-based material and leather construction. The seals 26,27 of these upper packings 25 have v-shaped cross-sections in the configuration shown in FIG. 1. The upper packings 25 are stationary and define the upper boundary 28 of an upper chamber 30 of the fluid section 10.

The fluid section 10 also contains lower seal packings 35 similarly configured with seals 26,27 of an alternating construction. These seals 26,27 also have v-shaped cross-sections although, for the configuration shown in FIG. 1, the cross-sections have an orientation opposite to those of the upper packings 25. The lower packings 35 are mounted directly onto the lower portion of the piston rod 15, and define the lower boundary 36 of the upper chamber 30. Because the lower packings 35 reciprocate with the piston rod 15, the lower boundary 36 is linearly movable and contributes to the positive displacement of fluid through the fluid section 10. Thus, the volume of the upper chamber 30 decreases during the upstroke cycle of reciprocation and increases during the downstroke cycle.

The piston rod 15 has a hollow barrel 40 coterminous at its lower end with the open end 42 of the piston rod 15. An internal rod ball check valve 50 is located within the piston rod 15 at the other end of the barrel 40. The rod ball check valve 50 includes a rod ball 52 movable within the check valve passage 54. The check valve 50 also includes a seat 56 coterminous with the upper end of the barrel 40, and one or more transfer ports 58 to allow fluid to pass from the lower chamber 60 to the upper chamber 30. The rod ball 52, when seated, and the inner wall of the barrel 40 cooperatively define the upper boundary of the lower chamber 60 of the fluid section 10.

An intake port 65 and intake passage 67 are located at the lower end of the fluid section 10. Interposed between the intake passage 67 and the lower chamber 60 is an intake ball check valve 70. The intake ball check valve 70 includes an intake ball 72 seated on a seat 74, the seat 74 being coterminous with one end of the intake passage 67. When seated, the intake ball 72 defines the lower boundary of the lower chamber 60.

Reciprocating pumps of the type herein described are typically driven by an electric single- or variable-speed motor (not shown), which may operate from a dc or ac voltage input. Hence, some means for translating the rotational motion of the motor to the linear, reciprocating motion of the piston rod 15 must be employed.

Figure 2:
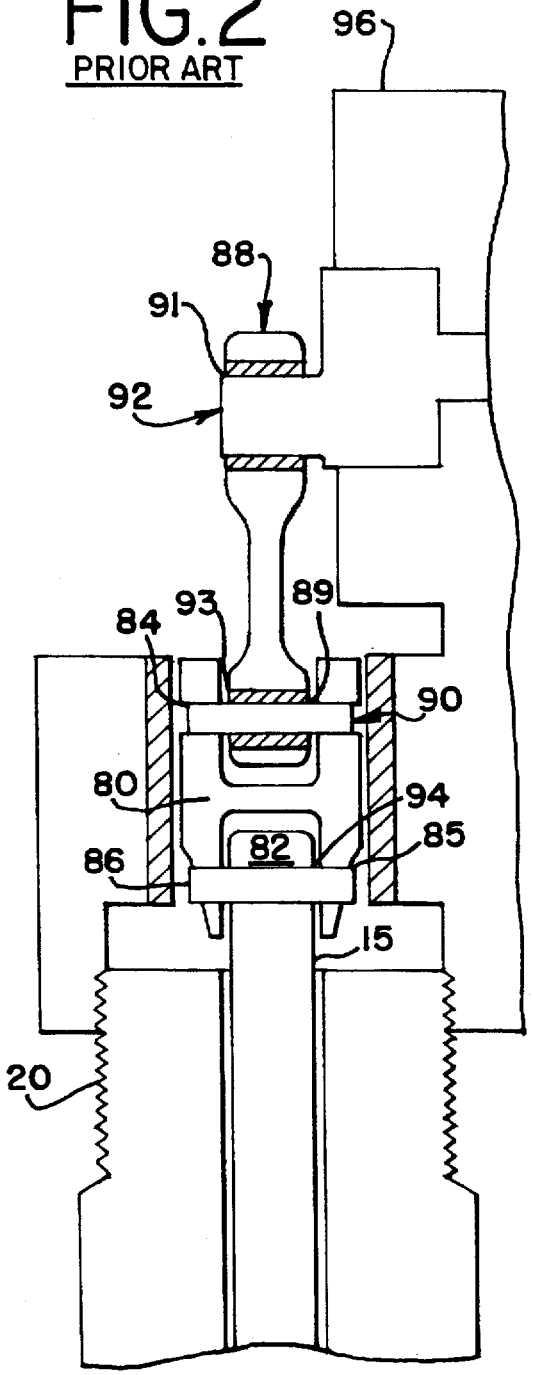
FIG. 2 PRIOR ART
FIG. 2 is a cross-sectional view of the upper portion of the piston rod and cylinder head assembly of a prior art reciprocating pump.
Figure 3:
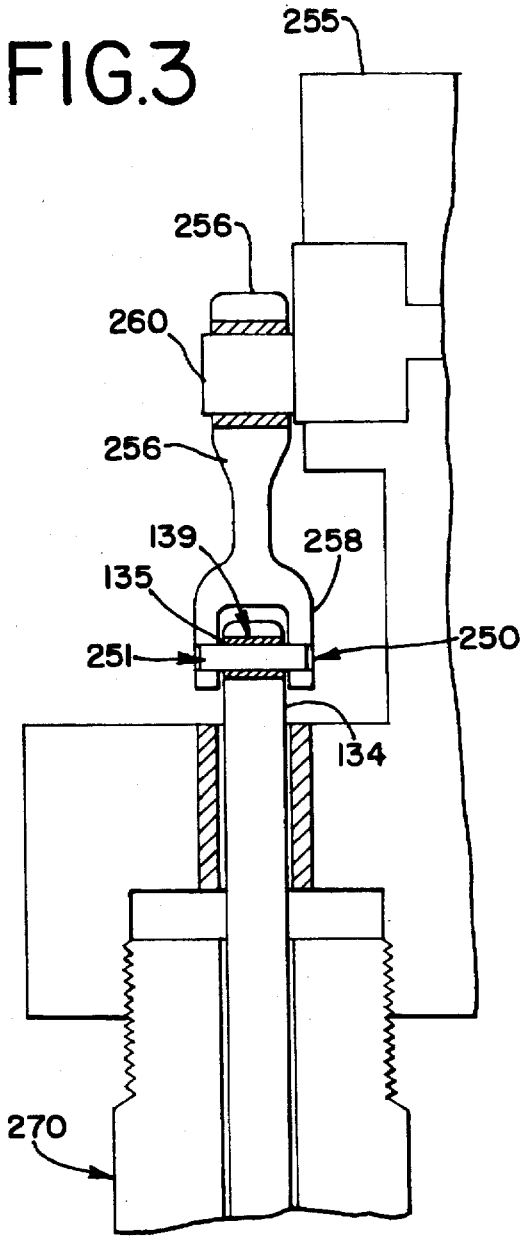
FIG. 3 is a cross-sectional view of an embodiment of the upper portion of the piston rod and cylinder head assembly of the present invention.

FIG. 2 illustrates the translating means commonly utilized in reciprocating pumps of the prior art. A crosshead 80 is fitted onto the upper end 82 of the piston rod 15, and has a hole 85 adapted to receive a pin 86. The lower portion of a connecting rod 88 has a wrist pin hole 89 at its lower end which aligns with a second hole 84 on the crosshead 80 to receive a wrist pin 90. The connecting rod 88 also has a crank end hole 91 at its upper end for engagement with the crank end 92 of the motor (not shown). The upper end 82 of the piston rod 15 also has a hole 94. When the crosshead 80 is properly fitted onto the upper end 82 of the piston rod 15, the hole 94 and crosshead hole 85 are co-aligned to receive the pin 86, and the crosshead hole 84 and the wrist pin hole 89 of the connecting rod 88 are co-aligned to receive the wrist pin 90. Both pins 86,90 are secured in place by some known means (not shown).

The inside surface of the wrist pin hole 89 typically is lined with a bushing 93 in order to provide a bearing surface for the wrist pin 90. Note that in order to access the bushing 93, the crosshead 80 and its supporting components must be disassembled.

The operation of the double-acting reciprocating pump of FIGS. 1 and 2 will now be described. When the motor is activated, power is transferred from the motor's rotating crankshaft, through the crank end 92, connecting rod 88, wrist pin 90, crosshead 80 and pin 86, to the piston rod 15, causing the piston rod 15 to reciprocate within the cylinder 20. The displacement of fluid through the fluid section 10 is basically accomplished by means of a two-stroke cycle consisting of an upstroke and a downstroke.

During upstroke the volume of the upper chamber 30 decreases, thereby causing fluid pressure in the upper chamber 30 to increase. This pressure increase closes the rod ball check valve 50 and forces the fluid in the upper chamber 30 through the discharge port 95. The fluid is then delivered under pressure through a conduit connected to the discharge port 95 to a desired destination. In the case of a paint spray system, paint is delivered to a paint spray nozzle.

As the pump shown is double-acting, fluid intake is also accomplished during upstroke. Thus, as the piston rod 15 travels upward, the volume of the lower chamber 60 increases and creates a vacuum in the lower chamber 60. This causes the intake ball check valve 70 to open, thereby drawing fluid into the lower chamber 60 from the intake passage 67. Depending on the particular pump application, the intake port 65 would be connected via a conduit to a fluid reservoir tank or some other suitable supply source.

During downstroke of the piston rod 15, the intake ball check valve 70 closes and fluid pressure builds in the lower chamber 60. When the pressure in the lower chamber 60 exceeds the pressure in the upper chamber 30, the rod ball check valve 50 opens and fluid from the lower chamber 60 is transferred to the upper chamber 30 via passage 54 and transfer port or ports 58. Note that the pressure in the lower chamber 60 will exceed the pressure in the upper chamber 30 almost instantaneously during this downstroke process, as the fluid used in most applications is substantially incompressible. This two-stroke cycle repeats as long as the motor is driving the fluid section 10.

It may be seen from FIG. 1 that the configuration of the stationary upper packings 25 and the reciprocating lower packings 35 presents two primary surfaces prone to pronounced wear during operation of the pump. The first is the outer surface of the piston rod 15, which wipes across the inner surfaces of the seals 26,27 of the upper packings 25 during reciprocation. The second is the inside surface of the cylinder 20 across which the outer surfaces of the seals 26,27 of the lower packings 35 travel. To extend the useful life of the piston rod 15 and cylinder 20, these high-wear surfaces (that is, the outside surface of the piston rod 15 and the inside surface of the cylinder 20) often are hard-chrome plated and ground and polished to an 8 RMS surface finish.

Such finishing treatments render components of the fluid section 10 quite expensive to purchase and to later replace. A partial solution found in the prior art has been to eliminate the "permanent" high-wear surface represented by the inside surface of the cylinder 20 by lining the inside of the cylinder wall 100 with a replaceable lining 105, as shown in FIG. 1. The lining 105 thus serves as a replaceable high-wear surface for contact with the reciprocating lower packings 35. While use of such a lining 105 may further extend the life of the cylinder 20, it represents yet another discrete high-wear surface which must be replaced by fully disassembling the fluid section 10 and using special tools and a press to remove the worn lining 105.

In addition to the high-wear surfaces of the piston rod 15 and the cylinder 20, the seals 26,27 of the upper and lower packings 25,35 themselves must be maintained throughout their useful life and replaced when necessary. The sealing capability of the packings 25,35 is critical to maintaining proper boundaries and fluid pressures in the upper and lower chambers 30,60, and hence overall efficiency of the pump. During operation of the fluid section 10, the seals 26,27 may be subject to several modes of wear. For example, the packings 25,35 may loosen, creating spaces between individual seals 26,27 as well as causing reductions in the width of the cross-sections of the seals 26,27. Depending on the fluid employed, the seals 26,27 may be subject to chemical degradation and thus further reduction in sealing capability due to loss of resiliency and dilation of cross-sectional area.

The sealing capacity of the packings 25,35 is maintained and the replacement times delayed by maintaining a good compression of the seals 26,27 of the packings 25,35. In the prior art fluid section 10 of FIG. 1, this is accomplished by adjusting the upper and lower packing nuts 110, 115. To maintain proper compression of the seals 26,27, the packing nuts 110,115 must be adjusted to compress the corresponding packings 25,35 a number of times before the packings 25,35 eventually require replacement. Adjustment of the upper packing nut 110 is relatively easy as the upper packing nut 110 is threadedly mounted on the outside of the cylinder 20, thereby permitting easy access. However, adjustment of the lower packing nut 115 is much more difficult, inconvenient and time-consuming, as the lower packing nut 115 is threadedly mounted on the piston rod 15 inside the cylinder 20. Hence, maintenance on the lower packings 35 requires closing or disconnecting supply and delivery lines, draining the pump, disassembling the fluid section 10 and pulling the piston rod 15 out from the cylinder 20 in order to gain access to the lower packing nut 115.

Because of the added difficulty of servicing the lower packings 35, in practice the lower packing nut 115 is almost never adjusted during the life of the lower packings 35. It will of course be apparent when the top packings 25 begin to leak, since an operator will observe fluid leaking out from the top of the cylinder 20 or aggregating on the outside surface of the piston rod 15. At such time the operator can easily tighten the upper packing nut 110 to stop the leak and continue to operate the pump. However, it will not be so evident from a visual inspection of the outside of the pump when the lower packings 35 begin to leak, as the leaking fluid will be contained in the upper and lower chambers 30,60 of a fluid section 10 already full of fluid. Leaking fluid can induce localized pressures and erosion, quickly damaging the replaceable lining 105 as well as the unprotected surfaces within the cylinder 20. This in turn leads to accelerated wear of the seals 26,27 and premature failure of the pump. It is safe to assume that the lower packings 35 will begin to leak at about the same time the upper packings 25 begin to leak but, as discussed previously, the lower packings 35 are rarely serviced in practice due to the complexity and tools required. Most commercial users of such pumps take their pumps back to the pump dealer for rebuild; this translates into down time and dealer repair expenses.

As discussed previously, a bushing 93 is ordinary fitted into the wrist pin hole 89 located at the lower end of the connecting rod 88 to provide a bearing for the various forces imparted to the wrist pin 90 (see FIG. 2), and by design is replaceable. However, replacement of the bushing 93 requires several steps as the connecting rod 88 is a separate part which, along with other supporting components, must first be removed from the crosshead 80 to gain access to the bushing 93. In addition, the crosshead 80 itself as a separate part is subject to translating forces and is prone to excessive wear, thus requiring frequent replacement. If the crosshead 80 or wrist pin bushing 93 is not replaced after becoming worn, the piston rod 15 will be subject to excessive lateral loads that will lead to additional wear and tear on the piston rod 15, the packings 25,35 and the lining 105 in the cylinder 20.

It should be understood at this point that while the prior art example herein described is directed to a double-acting reciprocating pump, single-acting reciprocating pumps and other positive displacement pumps utilizing piston rods require similar seal and bushing configurations and are subject to similar maintenance limitations.

To overcome the problems in the prior art, the present invention is directed generally to a pump wherein all high-wear surfaces are integrated into a modular piston rod assembly which may be removed from the pump as a single unit, or replacement set, for maintenance purposes. A specific embodiment of the present invention will now be described with reference to FIGS. 3–9, which illustrate a piston rod assembly for a double-acting reciprocating pump.

Figure 4:
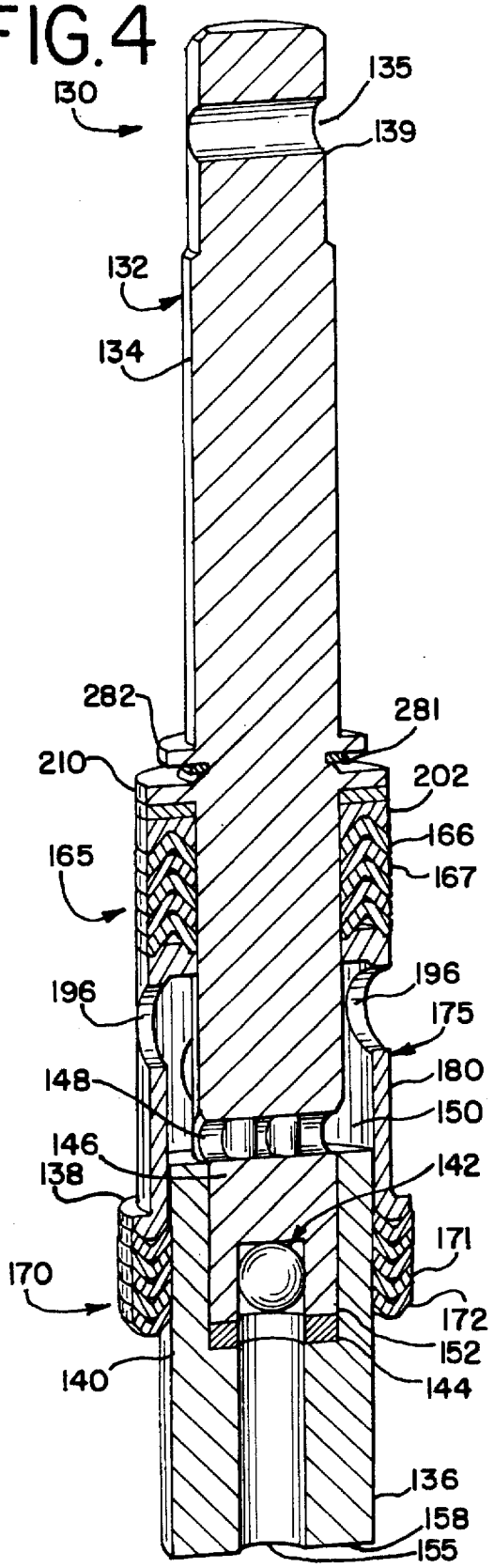
FIG. 4 is a cross-sectional view of an embodiment of the piston rod assembly of the present invention.
Figure 5:
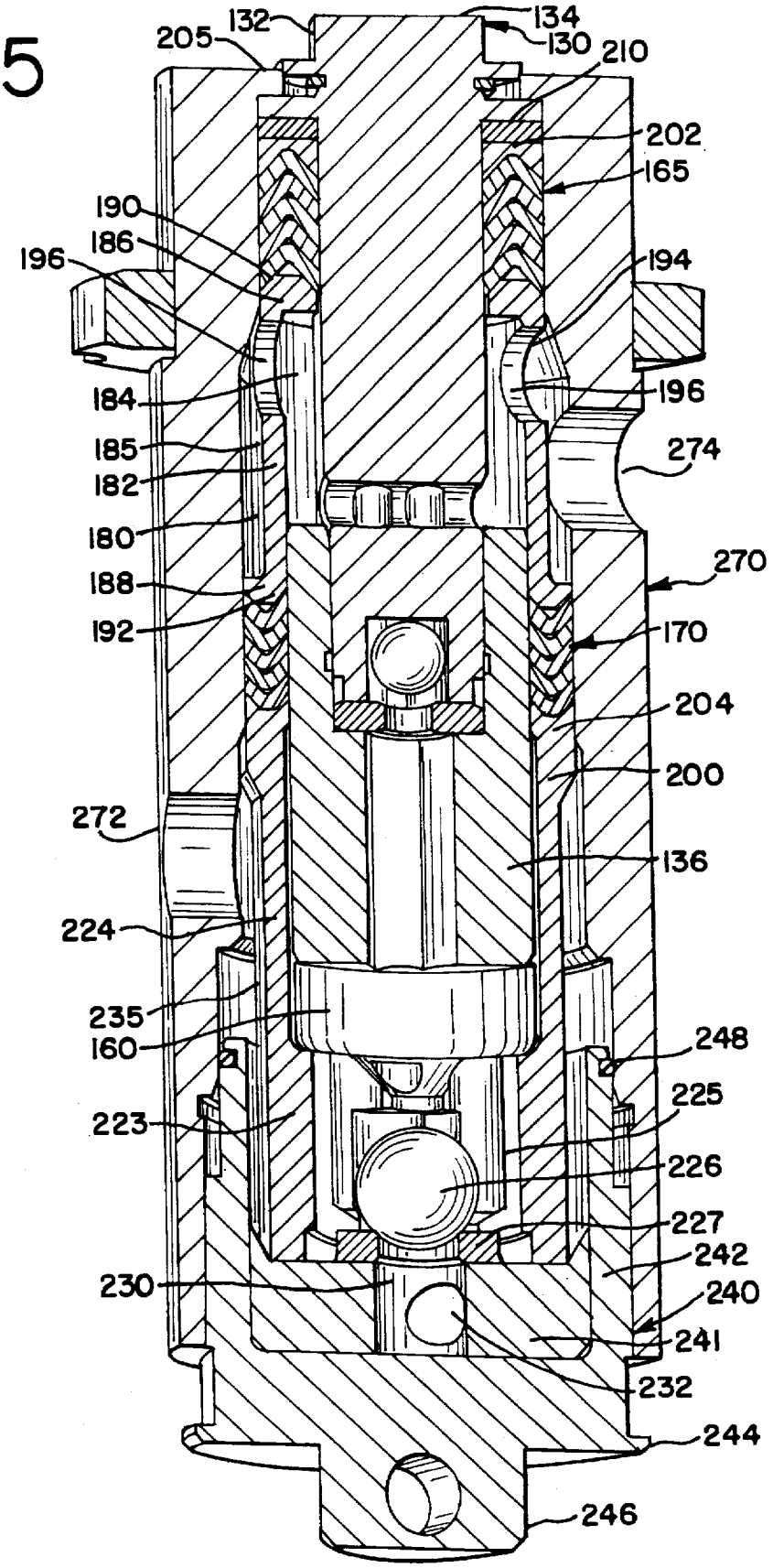
FIG. 5 is a cross-sectional view of an embodiment of the fluid section of a reciprocating pump of the present invention.

FIGS. 4 and 5 illustrate a piston rod assembly 130. In particular, FIG. 4 shows the piston rod assembly 130 removed from the outer cylinder 270, and FIG. 5 shows a cross-section of a fluid section 120 consisting of the piston rod assembly 130 installed in the outer cylinder 270.

The piston rod 132 has a two-part construction consisting of an upper rod 134 joined to a lower rod 136. Preferably, the cross-sectional area of the lower rod 136 is twice that of the upper rod 134 so that the volume of fluid moved is the same during both upstroke and downstroke. The upper portion of the lower rod 136 has a threaded bore 138 into which the lower end of the upper rod 134 may be screwed. The rod ball check valve 140 is built into the lower end of the upper rod 134, and contains a rod ball 142 and an annular rod ball seat 144. One or more transfer passages 146 extend through the upper rod 134 from the rod ball check valve 140 to one or more transfer ports 148. The transfer port or ports 148 are located on the outer surface of the upper rod 134 above the top of the lower rod 136 in the upper chamber 150, thus permitting fluid from the rod ball check valve 140 to pass to the upper chamber 150. A rod seal 152 may be interposed between the inner surface of the bore 138 of the lower rod 136 and the outer surface of the upper rod 134 adjacent the rod ball check valve 140 in order to seal the engagement tolerance of the upper rod 134 and lower rod 136 interface.

The lower rod 136 has a hollow barrel 155 which has a diameter less than that of the bore 138, and which extends from the lower end 158 of the lower rod 136 to the bottom of the lower rod bore 138. The upper end of the barrel 155 is coterminous with the bottom of the bore 138 and the rod ball seat 144 and the lower end of the barrel 155 is coterminous with the lower end 158 of the lower rod 136, thus permitting passage of fluid from the lower chamber 160 to the rod ball check valve 140. Preferably, the barrel 155 has a hexagonal cross-section, and is thus adapted to receive the hexagonal shaft of a tool to facilitate connection and disconnection of the upper and lower rods 134,136.

Upper packings 165, consisting of a plurality of stacked annular seals 166,167, are disposed above the upper chamber 150 and circumferentially about the upper rod 134. The inner surfaces of the seals 166,167 sealingly contact the outer surface of the upper rod 134. Preferably, the seals 166,167 are arranged in a series of alternating, heterogeneous sealing materials such as a polymer-based material and leather. It is also preferable that the seals have the v-shaped cross-section shown in FIGS. 4 and 5, as such a configuration lends itself efficaciously to the compressing function to be described below.

Lower packings 170, consisting of a plurality of stacked annular seals 171,172, are disposed below the upper chamber 150 and circumferentially about the lower rod 136. The inner surfaces of the seals 171,172 sealingly contact the outer surface of the lower rod 136. The lower packings 170 are otherwise similar to the upper packings 165, and preferably have the alternating packing arrangement and v-shaped cross-sections. For reciprocating piston pumps, however, it has been found ideal to pack the seals 171,172 of the lower packings 170 such that the vertices of its v-shaped cross-sections have an opposing orientation with respect to the seals 166,167 of the upper packings 165, as shown in FIGS. 4 and 5.

In the present embodiment, the upper and lower packings 165,170 are both stationary with respect to the reciprocating piston rod 132. This is accomplished through the use of a unique, cylindrical packing sleeve 175. The packing sleeve 175 generally consists of an upper sleeve 180 and a lower sleeve 200.

As best illustrated in FIG. 5, the upper sleeve 180 consists of a shell portion 182. For the position of the piston rod 132 shown in FIG. 5, the shell 182 is disposed circumferentially about, and adjacent to, the upper region of the lower rod 136 and about the lower region of the upper rod 134. Because the diameter of the lower rod 136 is greater than the diameter of the upper rod 134, an annular space is created between the outer surface of the upper rod 134 and the part of the shell 182 adjacent the upper rod 134. This annular space partially defines an inner upper chamber 184—that is, the inner region of the upper chamber 150.

At the top of the shell 182, the upper sleeve 180 is flanged radially inward to form a rim or platform 186 upon which the upper packings 165 are compressibly mounted. The diameter of the inside edge of the platform 186 is slightly greater than the outside diameter of the upper rod 134 to provide a small tolerance therebetween. At the bottom of the shell 182, the upper sleeve 180 is flanged radially outward to form a rim or platform 188, extending between the outer surface of the lower rod 136 and the inner surface of the outer cylinder 270, against which the lower packings 170 below are compressibly mounted. The inner and outer diameters of the platform 188 are such as to permit small tolerances between the platform 188 and the lower rod 136, and the platform 188 and the outer cylinder 270, respectively. If desired, the corners of the top contact surface 190 of the platform 186 may be chamfered to partially receive the legs of the lowermost v-shaped seal 167 of the upper packings 165, to provide a tighter fit. Similarly, the corners of the bottom contact surface 192 of the platform 188 may be chamfered to partially receive the legs of the uppermost v-shaped seal 171 of the lower packings 170.

As shown in FIG. 5, the inner surface of the outer cylinder 270 begins to taper outward at a point 194 proximate the upper packings 165, such that the inside diameter of the outer cylinder 270 for a portion of the cylinder 270 substantially adjacent the shell 182 is greater than the inside diameter for a portion substantially adjacent the upper packings 165. By this configuration, the shell 182 of the packing sleeve 175 divides the upper chamber 150 into an inner upper chamber 184 and an outer upper chamber 185. Thus, the boundaries of the outer upper chamber 185 are defined by the tapered surface portion 194 of the outer cylinder 270, the portion of the inner surface of the cylinder 270 extending between the tapered surface 194 and the platform 188, the platform 188 itself, and the shell 182. The boundaries of the inner upper chamber 184 are defined by the shell 182, the top of the lower rod 136, the upper rod 134, and the platform 186.

Transfer of fluid from the inner upper chamber 184 to the outer upper chamber 185 is accomplished via a plurality of ports 196 in the shell 182. Note that, because the packings 165,170 will be compressed a number of times during their lives (in a manner to be described below), the packing sleeve 175 will tend to shift upwards in the cylinder 270. Thus, it is preferable that the shell ports 196 be interspersed about the shell 182 in an arrangement that ensures at least one or a few ports 196 will not be blocked by the narrower inner surface of the upper region of the outer cylinder 270.

In the preferred embodiment, an annular female adapter 202 is positioned above the upper packings 165 and circumferentially about the upper rod 134. The female adapter 202 fittingly conforms to the v-shape of the uppermost seal 166 of the upper packings 165 to provide a contact surface for the upper packings 165. Above the female adapter 202, the top of the outer cylinder 270 is flanged radially inward to form a shoulder 205. The diameter of the inside surface of the shoulder 205 is large enough to provide an opening through which the piston rod 132 may reciprocate, but is less than the diameter of the inside surface of the portion of outer cylinder 270 adjacent the upper packings 165. Thus, the shoulder 205 prevents removal of the female adapter 202, the upper and lower packings 165,170 and the packing sleeve 175 out from the top of the outer cylinder 270. In addition, the shoulder 205 provides a contact surface for the female adapter 202 against which the upper and lower packings 165,170 are compressed by means of a compression force transferred through the packing sleeve 175, to be described below. It is preferable to interpose a washer 210 between the female adapter 202 and the shoulder 205 in order to more evenly spread the pressure exerted on the female adapter 202 by the shoulder 205 under compressive conditions.

As best depicted in FIG. 5, the lower sleeve 200 is disposed circumferentially about a portion of the reciprocating lower rod 136 and extends from the lower packings 170 to the packing nut assembly 240, to be described below. The top of the lower sleeve 200 forms a female adapter 204 onto which the lowermost seal 172 of the lower packings 170 is fittingly mounted. The lower region 223 of the lower sleeve 200 houses an intake ball check valve 225, including the intake ball 226 and seat 227, which extends between the lower chamber 160 and the intake passage 230. The top of the intake ball check valve 226 and the surrounding lower region 223 of the lower sleeve 200 provide the lowermost limit for the downstroke of the piston rod 132.

The annular space between the lower sleeve 200 and the inner surface of the outer cylinder 270 defines an intake chamber 235 that is separate from the lower chamber 160. Fluid is transferred from the intake chamber 235 through the intake ball check valve 225 to the lower chamber 160 via one or more ports 232 in the intake passage 230.

It will be understood at this point that the present invention is not limited to a configuration of two packings, that is, upper packings 165 and lower packings 170. Depending on the pump design in which the present invention is embodied, a greater or lesser number of packings may be used and the packing sleeve 175 modified accordingly. Such variations fall within the scope of the present invention.

One object of the present invention is to provide a piston rod assembly that permits all seals associated therewith to be compressed in a single step. That object is accomplished through the cooperation of the packing sleeve 175 described hereinabove with a packing nut assembly 240, the preferred design of which will now be described. The packing nut assembly 240 consists of a cylindrical wall 242, an end plate 244 and nut 246. The lowermost section of the outer cylinder 270 is threaded so that the packing nut assembly 240 may be screwed into the bottom of the outer cylinder 270. Preferably, an O-ring 248 is located near the top of the packing nut assembly 240 between the packing nut assembly 240 and the inner surface of the outer cylinder 270 in order to seal off the intake chamber 235 from the threads of the packing nut assembly 240 and the outer cylinder 270. The packing nut assembly 240 provides a base 241 upon which the packing sleeve 175 is mounted.

Figure 6:
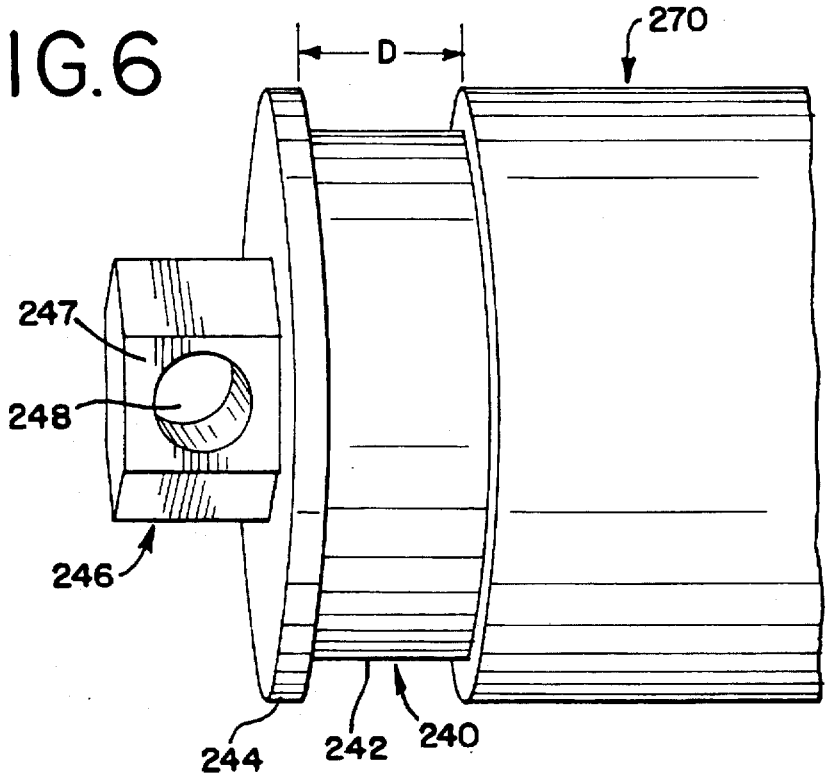
FIG. 6 is a perspective view of the packing nut assembly of the present invention.
Figure 7:
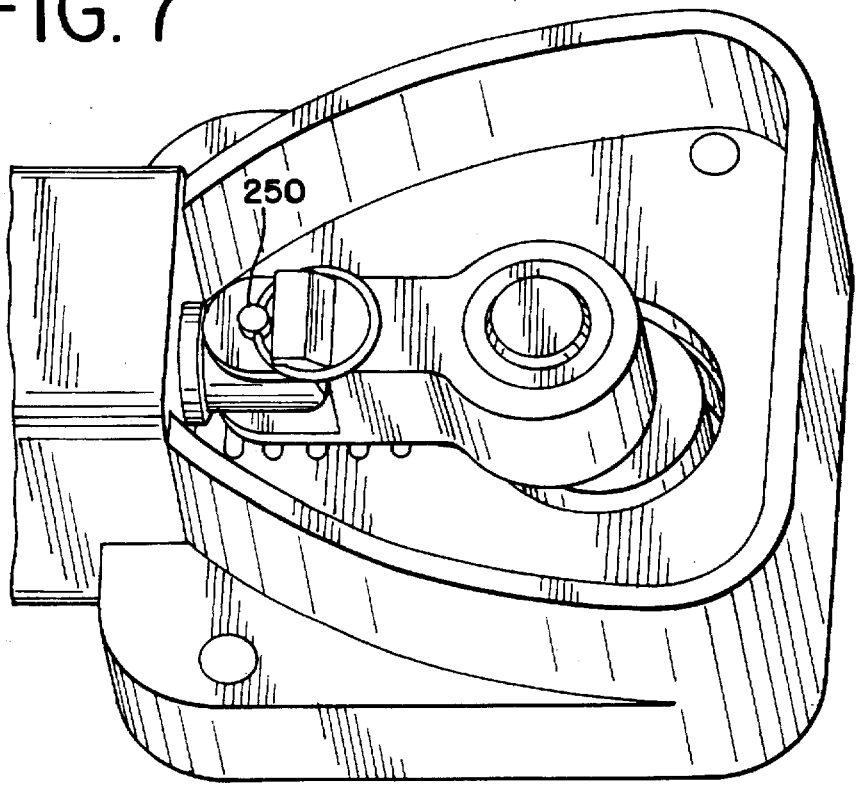
FIG. 7 is a perspective view of an embodiment of a cylinder head of the present invention.

As shown in greater detail in FIG. 6, the nut 246 is attached to the end plate 244. The nut 246 illustrated is hexagonal and contains six flats 247. As an alternative to or in addition to the hexagonal six-flat configuration, the nut 246 may also have a bore 248 transversely extending from one flat 247 to a diametrically opposed flat. Thus, the packing nut assembly 240 may be rotatably adjusted either by applying a wrench to the flats 247 of the nut 246 or by inserting the shaft of a tool into the bore 248. It thus may be seen that rotation of the packing nut assembly 240 in one direction causes the packing nut assembly 240 to axially displace upward, which in turn causes the packing sleeve 175 to axially displace towards the top of the outer cylinder 270.

By the configuration of the piston rod assembly 130 described herein, the force developed in this adjustment process is transferred through the lower sleeve 200, the lower packings 170, the upper sleeve 180, the upper packings 165, the female adapter 202 and the washer 210, and against the shoulder 205 of the outer cylinder 270. As the seals 166,167 of the upper packings 165 and the seals 171,172 of the lower packings 170 are resilient, such adjustment of the packing nut assembly 240 will compress the upper and lower packings 165,170 to improve sealing capacity. And, as previously discussed, the preferred v-shaped cross-section of the seals 166,167,171,172 enhances the effect of the adjustment. Furthermore, the configuration permits compressive adjustment of both upper and lower packings 165,170 simultaneously by means of a single step using a simple tool. In addition, as the nut 246 is located outside of the outer cylinder 270, the adjustment process does not require that the piston rod assembly 130 be removed from the outer cylinder 270 or that intake and discharge lines be disconnected. Finally, because the packing nut assembly 240 extends out from the outer cylinder 270 by a distance D (shown in FIG. 6), a good visual approximation of the extent of compression of—and thus the amount of resiliency remaining in—the upper and lower packings 165,170 may quickly be made.

Figure 8:
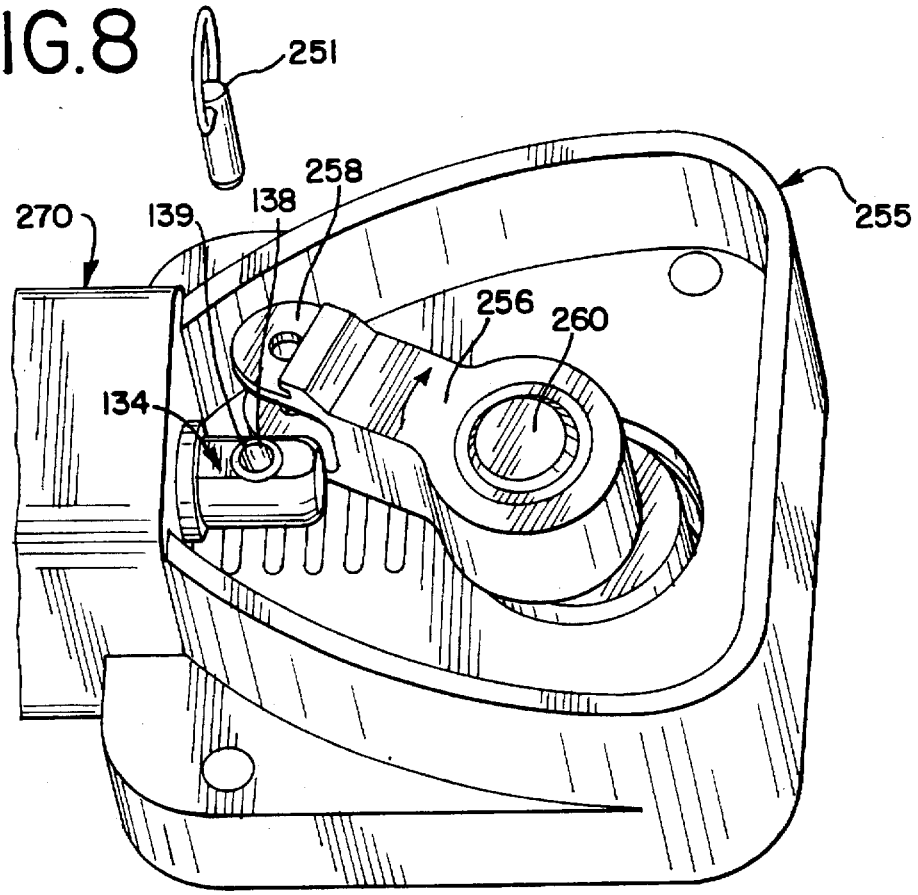
FIG. 8 is a perspective view of a second embodiment of the cylinder head of the present invention.
Figure 9:
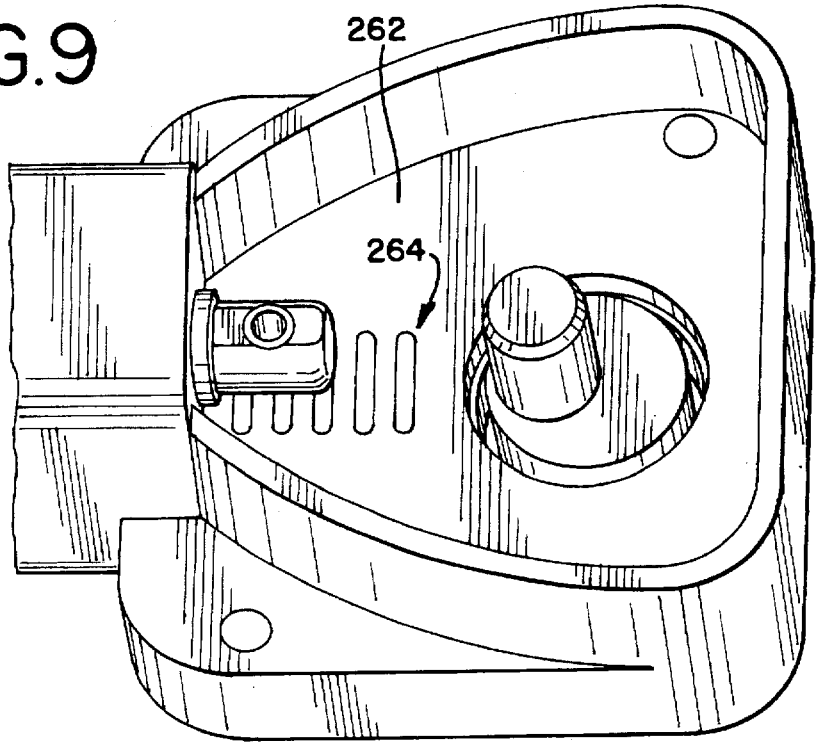
FIG. 9 is a perspective view of a third embodiment of the cylinder head of the present invention.

As shown in FIGS. 3, 4, 8 and 9, a hole 135 is located near the top of the upper rod 134 into which a hollow bushing 139 is inserted. The bushing 139 is adapted to receive a wrist pin 251. Referring to FIG. 8, a cylinder head 255 is mounted to the top of the outer cylinder 270, and houses the top of the upper rod 134, the wrist pin 251, as well as a connecting rod 256. In the embodiment shown, the connecting rod 256 has a bifurcated or forked end 258 which is adapted to straddle the top of the upper rod 134 and receive the pin 251. The other end of the connecting rod 258 is fitted onto the crank end 260 of a motor (not shown). As best seen in FIG. 9, the cylinder head 255 has a back plate 262. A series of slots 264 are formed on the inside surface of the back plate 262 and preferably centered about a longitudinal line parallel to the longitudinal axis of the upper rod 134. The function of the slots 264 will be described below.

The operation of the fluid section 120 will now be described. As the present invention has been described in the context of a double-acting reciprocating piston pump, the fluid section 120 displaces fluid by a two-stroke cycle. Within the cylinder head 255, the eccentric rotation of the connecting rod 256 effects linear, reciprocating motion of the piston rod 132 via the pin connection 250. During upstroke, fluid is drawn into the intake chamber 235 via the intake port 272. Since a vacuum is created in the volumetrically expanding lower chamber 160 during upstroke, the intake ball check valve 225 opens and fluid flows from the intake chamber 235 through the port or ports 232, the intake passage 230 and the seat 227, around the intake ball 226 and into the lower chamber 160. During this time, the rod ball check valve 140 is closed and the volume of the inner upper chamber 184 decreases, building fluid pressure in the entire upper chamber 150. This causes the fluid in the upper chamber 150 to discharge out the discharge port 274.

During downstroke, the intake ball check valve 225 is closed and the rod ball check valve 140 is open. As the volume of the lower chamber 160 decreases, fluid in the lower chamber 160 is transferred to the upper chamber 150 through the barrel 155 and the seat 144, around the rod ball 142, and through the transfer passage or passages 146 and the transfer port or ports 148.

It will be understood that the present invention is not confined to locating the intake port 272 on the side of the outer cylinder 270. The intake port 272 may, for example, be located at the end plate 244 of the packing nut assembly 240 to permit fluid to enter the fluid section 120 via the packing nut assembly 240. The intake port 272 may also be located directly at the nut 246 of the packing nut assembly 240. The side location, however, is preferred for the present embodiment as it permits the piston rod assembly 130 to be removed from the outer cylinder 270 without requiring disconnection of the intake line (not shown).

It will also be understood that the present invention is not confined to a vertical orientation of the fluid section 120. Many pumps are designed to operate with a horizontally reciprocating piston rod 132. It will further be understood that the present invention is not confined to a configuration wherein all critical components are cylindrical. For example, components having square cross-sections may be substituted for the outer cylinder 270, the packing sleeve 175, and the piston rod 132. The present invention encompasses such variations.

As discussed previously, the integrated design of the piston rod assembly 130 affords a number of advantages with regard to maintenance. Where it is desired only to remedy a leaking condition of the upper or lower packings 165,170 without removing and replacing any components, the task of maintaining or increasing compression in the packings 165,170 is accomplished simply by a single adjustment of the packing nut assembly 240. The unique design of the packing sleeve 175 permits the upper and lower packings 165,170 to be compressed simultaneously by this single step. In the preferred embodiment the packing nut assembly 240 is threadedly engaged with the outer cylinder 270, such that adjustment is effected by rotation of the packing nut assembly 240 at the nut 246. Since the nut 246 is located outside the outer cylinder 270, the adjustment task is greatly facilitated as it does not require disassembly of the fluid section 120. As discussed previously and as illustrated in FIG. 6, the degree of compression of the upper and lower packings 165,170 may be estimated by observing the distance D remaining between the end of the outer cylinder 270 and the end plate 244 of the packing nut assembly 240.

Preferably, a rod slinger 282 is mounted about the outer surface of the upper rod 134 at a location where the rod slinger 282 will not interfere with the reciprocation of the piston rod 132. In the event of a leaking condition, the rod slinger 282 prevents fluid from wicking or running up the piston rod 132 during operation of the pump.

It should also be noted that the design of the packing sleeve 175—wherein all packings 165,170 are stationary with respect to the outer cylinder 270—greatly extends the useful life of the outer cylinder 270. Because no packings reciprocate across the inside surface of the cylinder 270, the need for a replaceable lining 105 as used in prior art fluid sections (see FIG. 1) is eliminated.

From time to time, it still will be necessary to remove the piston rod assembly 130 in order to replace one or more damaged seals 166,167,171,172, worn upper and lower packings 165,170, worn upper and lower rods 134,136, as well as the bushing 139. The design encompassed by the present invention facilitates this maintenance by providing an integrated, modular piston rod assembly 130 that incorporates all of these high-wear components into a single unit. For most applications of the present invention, the useful lives of the upper and lower packings 165,170, the upper and lower rods 134,136, and the bushing 139 will be substantially coextensive. As a result, the present invention renders it more practicable and economical to replace the entire piston rod assembly rather than performing maintenance on the individual components thereof. Thus, the piston rod assembly 130 may be considered a single replacement set. The method of replacing the piston rod assembly will now be described.

Referring to FIGS. 5, and 7-9, the front cover (not shown) of the cylinder head 255 is removed to gain access to the pin connection 250. The wrist pin 251 is removed to disconnect the connecting rod 256 from the upper rod 134. The connecting rod 256 is then rotated out of the way and removed from the crank end 260 to expose the slots 264 on the back plate 262. Applying a wrench or the shaft of a tool (not shown) to the nut 246 of the packing nut assembly 240, the packing nut assembly 240 is rotated in an appropriate direction to loosen the upper and lower packings 165,170 and to remove the axial, compressive holding force imparted upon the packing sleeve 174 in the outer cylinder 270. The packing nut assembly 240 is then removed from the outer cylinder 270. A lever (not shown), such as the spatulated end of a screwdriver, is inserted into one of the slots 264 and pivoted downward to contact the top of the upper rod 134 and urge the piston rod assembly 130 as a single unit out from the outer cylinder 270. To keep the components of the piston rod assembly 130 together during removal, it is preferable that the upper rod 134 have a retainer ring 281 attached thereto so that the packing sleeve 175 slides out from the outer cylinder 270 along with the piston rod 132. The retainer ring 281 is located on the upper rod 134 at a point where it will not interfere with the reciprocation of the piston rod 132.

The piston rod assembly 130 having been removed from the outer cylinder 270, one or more maintenance tasks may then be performed on the individual components. On the other hand, the entire piston rod assembly 130—comprising the upper and lower rods 134,136, the bushing 139, the rod ball check valve 140, and the packing sleeve 175 containing the upper and lower packings 165,170—may be replaced with a new piston rod assembly (i.e., a replacement set). The new piston rod assembly is then installed into the outer cylinder 270 by executing the steps discussed hereinabove in reverse order. This can be done on site in only a few minutes by a system operator.

While the specific embodiments have been illustrated and described, numerous modifications come to mind without significantly departing from the spirit of the invention and the scope of protection is only limited by the scope of the accompanying Claims.

I claim:

1. An assembly for fluidly sealing a piston member in a pump comprising:

a piston member having an outer surface;

a first compressible sealing material having an inner surface and disposed adjacent said piston member, said inner surface of said first sealing material sealingly contacting the outer surface of said piston member;

a second compressible sealing material having an inner surface and disposed adjacent said piston member, said inner surface of said second sealing material sealingly contacting the outer surface of said piston member; and, a sleeve for mounting said first and second sealing materials in a spatial axial relation to each other, said sleeve having an end and a wall, said sleeve disposed adjacent the outer surface of said piston member and adapted for transferring through said wall a volume of fluid within said pump, wherein axial displacement of said sleeve at said end compresses both said first and second sealing materials.

2. The assembly of claim 1 wherein the sleeve has a first portion and a second portion, the first portion contacting the first and second sealing materials and the second portion contacting the second sealing material.

3. The piston assembly of claim 2 further comprising an outer cylinder disposed about said sleeve.

4. The piston assembly of claim 1 wherein:

said outer cylinder has an inner surface;

said first sealing material has an outer surface sealingly contacting said inner surface of said outer cylinder;

said second sealing material has an outer surface sealingly contacting said inner surface of said outer cylinder;

said first and second sealing materials cooperatively seal a first chamber within said outer cylinder; and, said second sealing material seals a second chamber within said cylinder.

5. The piston assembly of claim 2 wherein said sleeve includes a frame having first and second regions, said first region adapted to mount said first sealing material and said second region adapted to mount said second sealing material.

6. The piston assembly of claim 1 wherein said sleeve is adapted to permit removal of said first and second sealing materials from said outer cylinder.

7. The piston assembly of claim 1 wherein said piston member includes first and second regions, said first region of said piston member removably attached to said second region of said piston member.

8. The piston assembly of claim 1 wherein the first and second sealing materials each include a plurality of seals.

9. The piston assembly of claim 8 further comprising:

a housing having first and second ends and defining a chamber, wherein said sleeve, said first and second sealing materials and a portion of said piston member are disposed within said chamber;

means for preventing said sleeve from exiting the first end of said housing; and, means for axially displacing said sleeve to compress said first and second sealing materials.

10. The piston assembly of claim 8 wherein said displacing means includes a packing nut assembly adjustably disposed at the second end of said housing, said packing nut assembly operatively contacting said sleeve, wherein adjustment of said packing nut assembly urges said sleeve against said preventing means to compress both first and second sealing materials.

11. The piston assembly of claim 1 wherein said housing has an inner surface and said preventing means include a shoulder protruding from said inner surface into said chamber, said shoulder adapted to contact said sleeve.

12. The piston assembly of claim 1 wherein said piston member has a longitudinal axis, an end, and a hole proximate said end and transversely aligned relative to said longitudinal axis, said piston member further including a bushing disposed within said hole.

13. The assembly of claim 1 wherein the piston member further includes a first longitudinal axis, a first end, and a first hole proximate said first end and transversely aligned relative to said first longitudinal axis, said first hole having an inner surface, the assembly further comprising:

a connecting member having a second longitudinal axis, a second end, and a second hole proximate said second end and transversely aligned relative to said second longitudinal axis;

a hollow, cylindrical bushing having an outer surface and disposed within said first hole, wherein said outer surface contacts the inner surface of said first hole; and, a pin operatively and removably engaged with said bushing and said second hole, said pin adapted to translate oscillatory motion of said connecting member to linear motion of said piston member.

14. An assembly for fluidly sealing a piston rod in a double-action pump comprising:

a first rod having a first end, a second end and an outer surface;

a second rod having an outer surface, said second rod removably attached to said second end of said first rod;

a first compressible sealing material having inner and outer surfaces and disposed adjacent said first rod, wherein the inner surface of said first sealing material sealingly contacts a portion of the outer surface of said first rod;

a second compressible sealing material having inner and outer surfaces and disposed adjacent said second rod, wherein the inner surface of said second sealing material sealingly contacts a portion of the outer surface of said second rod; and, a sleeve for mounting said first and second sealing materials in a spatial axial relation to each other, said sleeve having an end, said sleeve disposed adjacent the outer surfaces of said first and second piston rods, wherein adjustment of said sleeve at said end causes axial displacement of said sleeve and compresses both said first and second sealing materials.

15. The piston rod assembly of claim 14 further comprising an outer cylinder having first and second ends, said outer cylinder disposed about said sleeve, said first and second sealing materials, and a portion of said piston rod.

16. The piston rod assembly of claim 12 wherein said first and second sealing materials each include a plurality of stacked seals.

17. The piston rod assembly of claim 16 wherein each seal of said first and second sealing materials has a v-shaped cross-section.

18. The piston rod assembly of claim 17 further comprising a connecting rod and means for rotatably connecting said connecting rod to said first rod, said connecting means adapted to permit translation of oscillatory motion of said connecting rod to linear motion of said first rod.

19. The piston rod assembly of claim 13 wherein said first rod has a longitudinal axis and a hole, said hole proximate the first end of said first rod and transversely aligned relative to the longitudinal axis, said connecting rod has a longitudinal axis and a hole transversely aligned relative to the longitudinal axis of said connecting rod, and said connecting means include a pin operatively and removably engaged with said hole of said first rod and said hole of said connecting rod.

20. The piston rod assembly of claim 19 wherein said first rod further includes a hollow, cylindrical bushing disposed within the hole of said first rod, said bushing adapted to receive said pin.

21. The piston rod assembly of claim 12 further comprising a cylinder head secured to the first end of said outer cylinder, said cylinder head defining a chamber and housing said connecting rod and said connecting means, wherein a portion of said first rod extends into said chamber.

22. The piston rod assembly of claim 12 wherein said cylinder head includes a back plate having an inner surface and a plurality of slots formed on said inner surface of said back plate.

23. The piston rod assembly of claim 22 wherein said first rod has a longitudinal axis and a hole, said hole proximate the first end of said first rod and transversely aligned relative to the longitudinal axis, and said first rod includes a hollow, cylindrical bushing disposed within said hole of said first rod.

24. The piston rod assembly of claim 23 wherein said sleeve comprises a packing sleeve, said packing sleeve including a shell having a first portion and a second portion, said packing sleeve peripherally and axially adjustably disposed about said first and second rods, wherein said first sealing material is mounted in said first portion of said shell and said second sealing material is mounted in said second portion of said shell.

25. The piston rod assembly of claim 23 further comprising:

an outer cylinder having a first end, a second end and an inner surface, said outer cylinder housing said second rod, said packing sleeve and a portion of said first rod, said outer cylinder including means for preventing said packing sleeve from exiting said first end of said outer cylinder, wherein the outer surfaces of said first and second seals are in sealable contact with said inner surface of said outer cylinder; and, a packing nut assembly including a cylindrical wall, said cylindrical wall adjustably and removably engaged with the second end of said outer cylinder, wherein adjustment of said wall of said packing nut assembly causes axial displacement of said packing sleeve against said preventing means of said outer cylinder to maintain compression of said seals of said first and second packings.

26. The piston rod assembly of claim 25 wherein said cylindrical wall of said packing nut assembly is removably engaged with the second end of said outer cylinder to permit removal of said first rod, said second rod, said packing sleeve and said first and second sealing materials from said outer cylinder.

27. The piston rod assembly of claim 23 wherein a portion of said cylindrical wall of said packing nut assembly axially end of said side of and beyond the second end of said outer cylinder assembly, wherein the amount of extension of said portion of wall provides visual indication of the degree of compression of said seals of said first and second packings.

28. An assembly for fluidly sealing a piston member in a pump comprising:

a piston member having an outer surface;

a first compressible sealing material having a first inner surface and a first outer surface, the first sealing material disposed adjacent the piston member and the first inner surface sealingly contacting the outer surface of the piston member;

a second compressible sealing material having a second inner surface and a second outer surface, the second sealing material disposed adjacent the piston member and the second inner surface sealingly contacting the outer surface of the piston member;

a sleeve for mounting the first and second sealing materials in a spatial axial relation to each other, the sleeve having an end, the sleeve disposed adjacent the outer surface of the piston member, wherein axial displacement of the sleeve at the end compresses both the first and second sealing materials;

an outer cylinder having an inner surface and disposed about the sleeve, wherein the first and second outer surfaces each sealingly contacts the inner surface of the outer cylinder, the first and second sealing materials cooperatively seal a first chamber within the outer cylinder, and the second sealing material seals a second chamber within the outer cylinder.

29. The assembly of claim 28 wherein a portion of the sleeve is adapted for mounting the first and second sealing materials in a spatial axial relation to each other, the portion having a wall and adapted for transferring through the wall a volume of fluid within the pump.

30. An assembly for fluidly sealing a piston member in a pump comprising:

a piston member having an outer surface and including first and second portions, the first portion removably attached to the second portion;

a first compressible sealing material having a first inner surface and disposed adjacent the piston member, the first inner surface sealingly contacting the outer surface of the piston member;

a second compressible sealing material having a second inner surface and disposed adjacent the piston member, the second inner surface sealingly contacting the outer surface of the piston member; and, a sleeve for mounting the first and second sealing materials in a spatial axial relation to each other, the sleeve having an end and disposed adjacent the outer surface of the piston member, wherein axial displacement of the sleeve at the end compresses both the first and second sealing materials.

* * * * *